US005226575A

United States Patent [19]

Faust

[11] Patent Number: 5,226,575

[45] Date of Patent: Jul. 13, 1993

[54] PNEUMATIC MORTAR DISPENSER WITH FLEX RELEASE

[76] Inventor: Scott Faust, 720 Dunkels Ch. Rd., Kutztown, Pa. 19530

[21] Appl. No.: 795,747

[22] Filed: Nov. 21, 1991

[51] Int. Cl.[5] ..... E04G 21/00

[52] U.S. Cl. ..... 222/611.2; 222/397; 222/462

[58] Field of Search ..... 222/327, 394, 397, 399, 222/460, 462, 611.2; 137/209; 251/342

[56] References Cited

U.S. PATENT DOCUMENTS

| | | | |
|---|---|---|---|
| 1,782,681 | 11/1930 | Foss et al. | 222/394 X |
| 2,785,016 | 3/1957 | Vollertzen et al. | 251/342 X |
| 2,943,768 | 7/1960 | Lindsay | 222/327 |
| 3,136,456 | 6/1964 | Sherbondy | 222/327 |
| 3,258,176 | 6/1966 | Raczynski | 222/397 |
| 3,844,449 | 10/1974 | Atter | 222/399 X |
| 3,871,553 | 3/1975 | Steinberg | 222/397 X |
| 3,921,858 | 11/1975 | Bemm | 222/397 X |
| 4,113,151 | 9/1978 | Brown et al. | 222/327 X |
| 4,174,868 | 11/1979 | DeNardo | 222/327 X |
| 4,671,431 | 6/1987 | Obrist | 222/327 |

FOREIGN PATENT DOCUMENTS

| | | | |
|---|---|---|---|
| 1686636 | 12/1950 | Fed. Rep. of Germany | 222/394 |
| 1110410 | 2/1956 | France | 222/611.2 |

*Primary Examiner*—Andres Kashnikow
*Assistant Examiner*—Kenneth Bomberg
*Attorney, Agent, or Firm*—John P. Halvonik

[57] ABSTRACT

The invention comprises a pneumatic gun for applying mortar in small scale applications, especially for one man operations around the home. The gun may also be used for mason contractor use. The gun uses an air supply fed by a thumb activated air nozzle that supplies air pressure to the top of a column of mortar inside a small dome shaped reservoir. A flex-type pressure release hose between the thumb trigger and the reservoir allows the pressure to be released to stop the flow of mortar upon flexing the hose.

5 Claims, 2 Drawing Sheets

PNEUMATIC MORTAR DISPENSER WITH FLEX RELEASE

BACKGROUND

1. Field of the Invention

The invention relates to small scale mortar delivery systems and, in particular, to a system designed for household or domestic usage for applications involving one man.

2. PRIOR ART

While mortar delivery systems do exist, most are for industrial uses and none that applicant is aware of use the flex type pressure release.

SUMMARY OF THE INVENTION

The mortar apparatus of the present invention is lightweight, and of small size to make it convenient for use in one man operations. A small column of mortar is held within a light weight mortar reservoir. The mortar is under air pressure supplied by a source of pressurized air fed through a line to the top of the reservoir. Between the reservoir and the source of pressurized air is a flex type pressure relief valve to allow the user to quickly stop the flow of mortar by flexing on the valve and causing the air pressure to be released.

It is the object of the invention to provide a small lightweight dispensing unit for one man mortar operations.

Another objective is to provide a mortar delivery system with a flex type release to allow one to quickly cut off the flow of mortar in a pneumatic mortar applicator.

Other objectives of the invention will become apparent once the invention is shown and described.

DESCRIPTION OF THE PREFERRED EMBODIMENT

Figure 1:
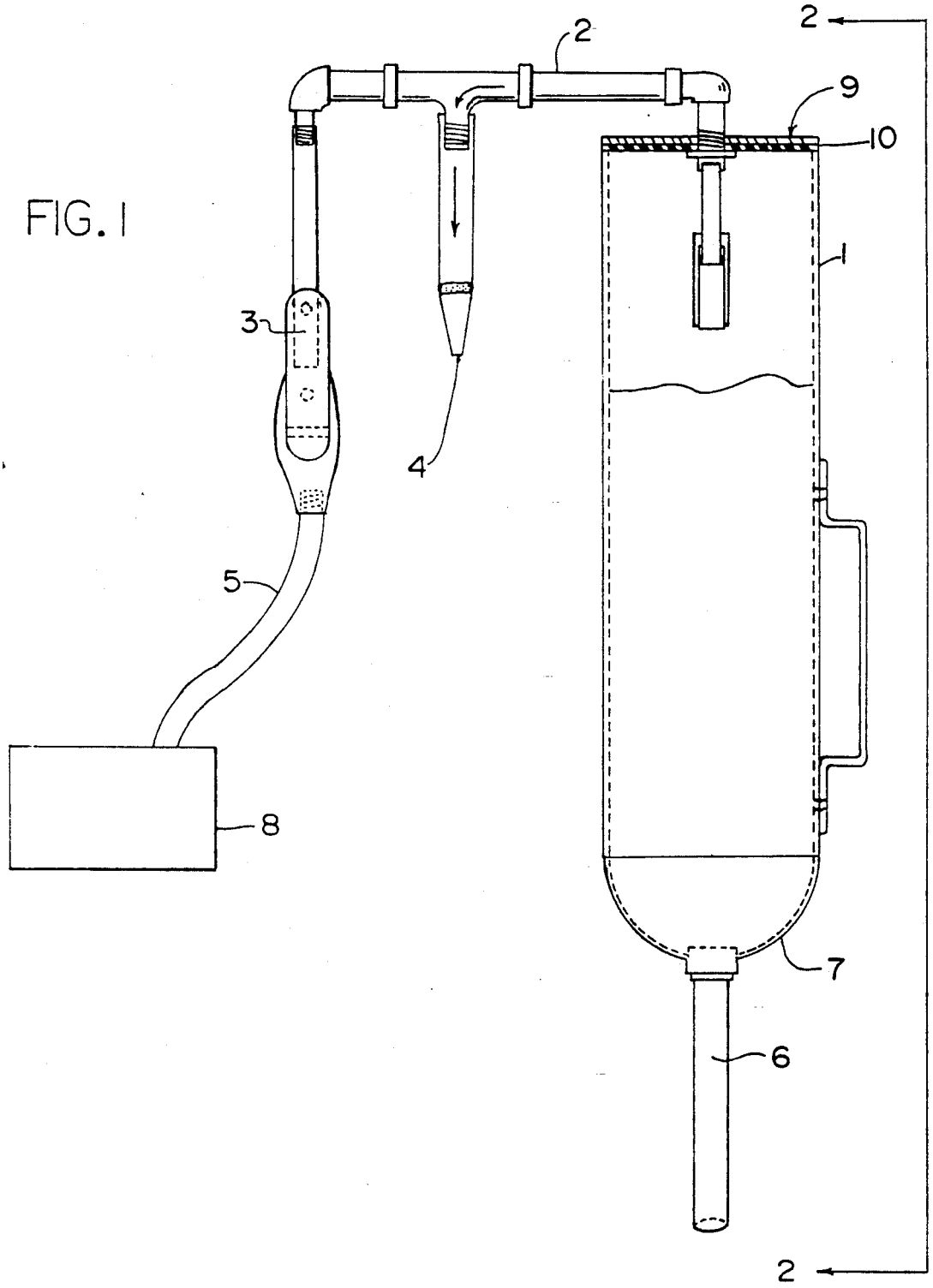
FIG. 1 shows the overall construction of the mortar dispenser.
Figure 2:
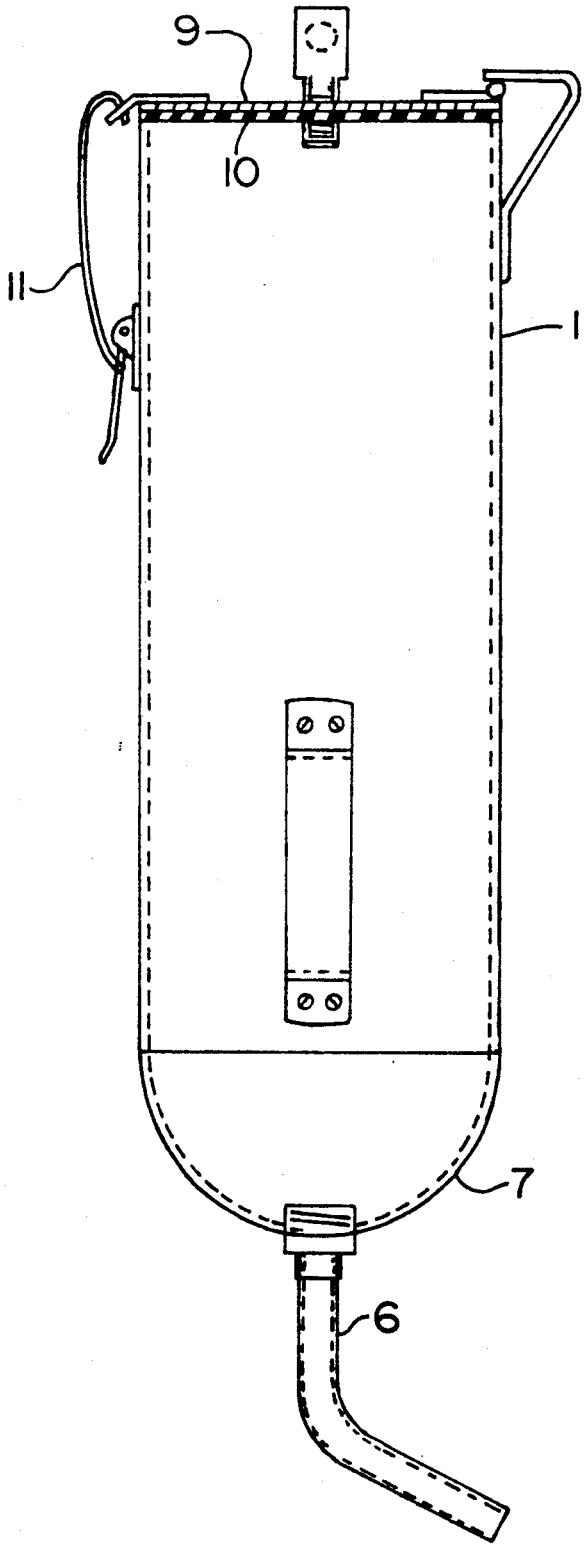
FIG. 2 shows a side view of the dispenser.

The invention comprises a small lightweight, mortar containing vessel 1 preferably made of aluminum and of a small size. The size should be chosen so that the vessel can be filled with mortar and not be so heavy that one person cannot handle it. The preferred size would be about 4" in width and about 15" in height. The preferred shape would be cylindrical with a bottom section 7 of domed shape and of very smooth interior surface so as to prevent flow resistance and to help channel the mortar out of the nozzle.

The bottom of the vessel should have a nozzle 6 or similar means for dispensing mortar from the vessel. The nozzle would preferably be made of rubber or other resilient material for easy application to surfaces. There may be a metal nozzle at the bottom of the vessel to facilitate attachment to the rubberized nozzle.

The top of the vessel should have a reclosable lid 9 so that the mortar may be placed in the vessel for use. A gasket seal 10 may be used around the rim of the vessel and the lid can be closed upon the seal by means of a series of latches 11. This creates a seal over the vessel for the pressurized air. The lid should be able to be connected to an air hose or other source of pressurized air 8 through an air line 2 so that pressurized air can b sent to the column of mortar in the vessel so that the mortar may be dispensed.

Any source of pressurized air may be used and should be in connection with the mortar column in the vessel by a hose or other air line. It is preferred that the pressure be about 20–25 lbs per square inch. At some point in the line there is placed a thumb activated air nozzle 3 that can be manually operated by a single individual using the system. The thumb activated nozzle has a trigger and when the trigger is depressed, pressurized air is sent to the column of mortar. When it is desired to stop the flow of mortar, the thumb trigger is released.

Between the thumb trigger and the vessel is a flex type pressure release 4. The release extends the air passage to the atmosphere so at that point in the air passage there is a T shape in the passage at the intersection of the pressure release and those parts of the air line that go to the trigger and mortar vessel. Using the pressure release one can control the movement of the air pressure, either to the vessel to dispense mortar or out the release to stop the flow. The release acts as a one-way valve to exhaust air and is activated by flexing the air hose to one side or the other with a slight movement.

It is important to have the release because even when the thumb trigger is released there is still pressurized air in the vessel and hose which needs to be released. This may be conveniently done by the user of the applicator when he is done dispensing mortar for a time. Any slight flexing of the release will cause air pressure to flow out and this cuts off the pressure to the vessel and stops the flow of the mortar.

I claim:

1. A pneumatic mortar application apparatus for dispensing mortar comprising: air passage means for allowing passage of pressured air from a source of pressurized air, a mortar containment vessel having a dispensing nozzle on a bottom end and lid means for refilling said vessel on a top end, said lid means in connection with one end of said air passage means so as to form an air line between said source of pressurized air and said vessel, thumb activated means along said air line for allowing the passage of said pressurized air to said containment vessel, manually operated flex-type release means for releasing said air pressure upon flexing said release means to one side with a slight movement, said flex type release means along said air line between said thumb activated means and said vessel.

2. The apparatus of claim 1 wherein the bottom end of said vessel is of dome shaped construction and of smooth surface so as to channel said mortar out of said vessel through said dispensing nozzle.

3. The apparatus of claim 2 wherein said mortar vessel is about 4" wide and about 15" in height.

4. The apparatus of claim 3 wherein said vessel is made of aluminum.

5. The apparatus of claim 4 wherein said nozzle is made of rubber.

* * * * *